United States Patent [19]

Rhodes, Jr.

[11] 4,179,117

[45] Dec. 18, 1979

[54] PAPER ALIGNMENT ROLLERS

[75] Inventor: John H. Rhodes, Jr., Longmont, Colo.

[73] Assignee: International Business Machines Corporation, Armonk, N.Y.

[21] Appl. No.: 865,803

[22] Filed: Dec. 30, 1977

[51] Int. Cl.[2] ..... B65H 9/16

[52] U.S. Cl. ..... 271/251

[58] Field of Search ..... 271/251, 274, 248, 249, 271/250, 252, 229-231

[56] References Cited

U.S. PATENT DOCUMENTS

| | | | |
|---|---|---|---|
| 2,672,337 | 3/1954 | Lorig | 271/240 |
| 3,040,946 | 6/1962 | Briggs | 226/180 |
| 3,107,089 | 10/1963 | Lockey | 271/52 |
| 3,175,824 | 3/1965 | Albosta | 271/52 |
| 3,779,443 | 12/1973 | Regipa | 226/199 |
| 3,854,315 | 12/1974 | Winkler | 271/250 X |

FOREIGN PATENT DOCUMENTS

| | | | |
|---|---|---|---|
| 499323 | 5/1930 | Fed. Rep. of Germany | 271/251 |

OTHER PUBLICATIONS

IBM Technical Disclosure Bulletin, vol. 18, No. 5, pp. 1307-1308, Oct. 1975, "Sheet Aligner", S. R. Harding and J. C. Rogers.

IBM Technical Disclosure Bulletin, vol. 17, No. 10, p. 2971, Mar. 1975 "Sheet Positioning Apparatus", K. A. Lennon and C. R. Spurlock.

IBM Technical Disclosure Bulletin, vol. 16, No. 9, Feb. 1974, pp. 2921-2922, "Sheet Aligning Mechanism", C. D. Bleau.

*Primary Examiner*—Richard A. Schacher

*Attorney, Agent, or Firm*—Charles E. Rohrer

[57] ABSTRACT

Paper aligning rolls wherein the drive roll is skewed to the direction of travel in order to move paper toward a referencing edge while the backup roll is oppositely skewed to urge the paper away from the referencing edge. By selecting the coefficient of friction of the drive roll to be higher than the coefficient of friction of the backup roll, the paper is moved into the referencing edge with a controlled small resultant force tending to not crumple the paper. This system maintains a high forward drive force while minimizing the force tending to crumple.

2 Claims, 8 Drawing Figures

PAPER ALIGNMENT ROLLERS

This invention relates to alignment rollers for use in registering the side edge of a piece of paper to a side guide and more particularly to alignment rollers which are skewed relative to each other.

BACKGROUND OF THE INVENTION

In order to feed paper to processing devices such as document copier machines, it is frequently necessary to align the paper such that the side edge of the paper enters the processing station uniformly from piece to piece. In order to accomplish that alignment it is necessary to move the paper into the registering guide, but to do so without crumpling the edge of the paper. This has proved to be a fairly difficult problem, especially with very lightweight papers.

Prior art machines have typically used several different configurations of solid rollers in which the angle of the drive roller is set at a particular angle to provide a certain amount of referencing force relative to the drive force, i.e., as the paper was being moved forward the angle of the roller would also provide a force to move it sideways against the referencing edge. In the past it has been believed that the smaller the angle of the drive roller to the path the less the reference force as the paper is being driven down the paper path. As will be shown herein, this belief is faulty for the true reference edge force is a function of the drive force of the aligning roller and the resultant force vector of all forces that are applied to the sheet. Problems which prior art systems have encountered are that fairly high drive forces have been needed to move thick stock forwardly in order to counteract high drag forces, particularly when moving that stock around a bend. However, when moving thin paper drag forces are lower and the referencing force into the registering edge may be high and as a result the thin paper is crumpled. The typical problem of moving paper involves how does one align the sheet, provide a high drive force, and yet keep the referencing edge force low enough to not bend or damage the edge of the paper being referenced. It is, therefore, the object of this invention to provide alignment rollers which move the paper into a reference edge with a controlled force while maintaining sufficiently high drive forces to move all paper stocks in the drive direction without difficulty.

SUMMARY OF THE INVENTION

This invention involves alignment rollers which are skewed relative to each other, i.e., the backup roller is skewed away from the reference edge while the drive roller is skewed into the reference edge or vice versa. The coefficient of friction of the roller skewed to move paper into the reference edge is chosen to exceed that of the oppositely skewed roller.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

As mentioned above, it has been commonly believed in the past that the referencing force in driving a paper into a registration edge is a function of the sine of the angle of skew. The equation commonly used was reference force = sine of $\theta(\mu N)$, where $\theta$ is the angle of skew and N is the normal force exerted on the paper by the roll. Thus, the smaller the angle $\theta$ of the drive roller the less the reference force as the paper is driven down the paper path. To ascertain why this is wrong, consider that as the paper moves down the path and eventually moves against the reference edge it must either slip relative to the drive roller or be crumpled into the reference edge. Preferably it will slip relative to the drive roller. Consider also that if the paper does slip relative to the drive roller it will slip when the accumulated forces on the paper exert a resultant force at the roller nip equal to $\mu_d N_d$ (the drive roller driving force). Consider also that the accumulated forces that cause the roller to slip on the paper are the drag force of the paper in the path, the resisting force from the reference edge and any additional forces that are applied to the paper. In the invention described herein an additional force is provided due to the orientation of the backup roller.

Figure 1:
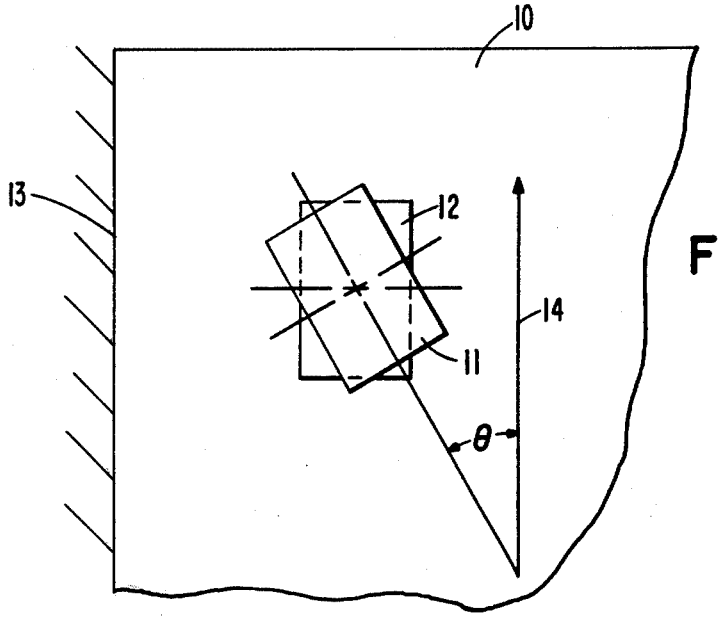
FIGS. 1 and 2 show the configuration of rollers found in the prior art.
Figure 2:
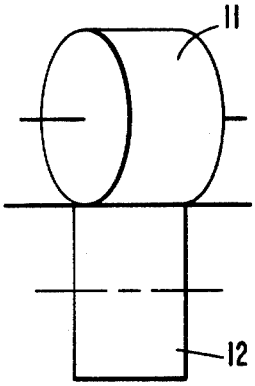
Figure 3:
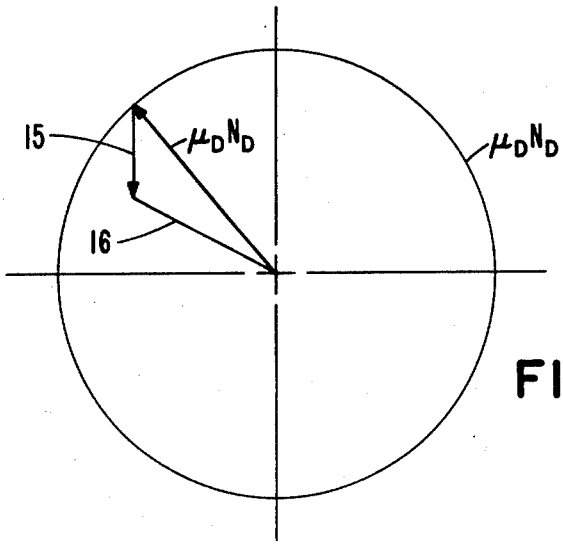
FIG. 3 shows a force vector diagram of the prior art arrangement.

FIGS. 1 and 2 illustrate the configuration of rollers found in the prior art. Paper sheet 10 is urged by drive roller 11 toward a reference edge 13. Backup roller 12 is parallel to the reference edge. The direction of travel of the paper is shown by arrow 14. The force vector diagram of such an arrangement is shown at FIG. 3. As stated above, if the paper is to slip at the nip of the aligning rollers once the paper has reached the reference edge the resultant force must equal the force produced by the drive roll, i.e., $\mu_d N_d$. The drag in the path may be determined by measuring the path drag and the direction of that force is opposite to the direction of travel. Since the amplitude and the direction of the path drag is defined, it can be placed on the vector diagram in FIG. 3 as shown at 15. The angle of the reference edge force 16, which is a function of the coefficient of friction of the paper on the reference edge, is known but the amplitude is not. As a consequence of this diagram, it may be observed that the force causing the paper to slip at the nip of the rolls produced by reference edge 13 is shown at 16, and the amplitude may be determined thereby.

As stated, it has been a commonly held belief that if the angle $\theta$ is reduced to zero, the referencing force on the paper tending to crumple the edge is reduced to zero. While this is correct, such a force vector would not produce any components driving the paper to the reference edge. However, the supposition was that if $\theta$ was kept small, the resultant referencing edge force tending to crumple the paper would be small. Note however, from the vector diagram in FIG. 3 that if $\theta$ approaches zero and if the paper is to slip at the nip once it reaches reference edge 13 there will always be produced a very significant force substantially equal in magnitude to the force vector shown at 16. This is easily ascertained from FIG. 3 since the magnitude of the drag force 15 and the basic $\mu_d N_d$ resultant force magnitude do not change.

Figure 4:
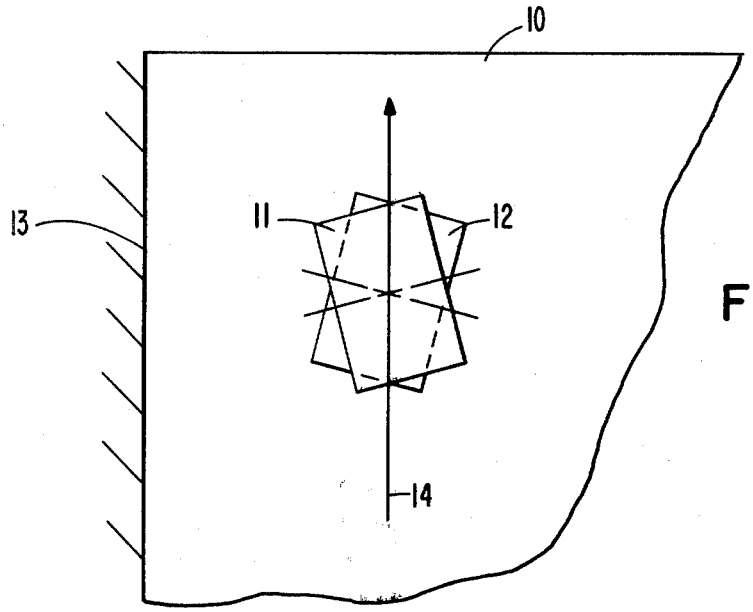
FIGS. 4 and 5 show the configuration of rollers for the current invention.
Figure 5:
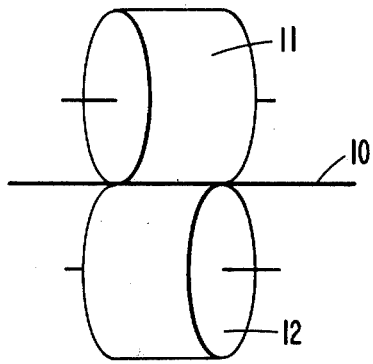
Figure 6:
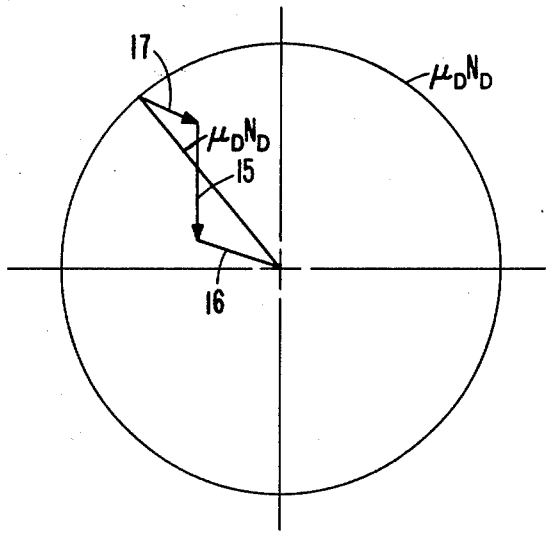
FIG. 6 is the vector diagram of the inventive arrangement.

As a result of this discovery, the inventor herein has supplied a system to minimize force 16 by skewing the backup roll 12 to produce an additional force vector to aid in overcoming $\mu_d N_d$. This system is shown in FIGS. 4, 5 and 6. Again, FIG. 4 represents a top view of the paper traveling in direction 14 under the influence of drive roll 11 and backup roll 12. The paper is being registered against a reference edge 13. FIG. 5 shows a front view of paper 10 in the nip of rollers 11 and 12. FIG. 6 is a force vector diagram of the forces of the system of FIGS. 5 and 6. In FIG. 6 the path drag force vector 15 which is of course opposite to the direction of travel 14 has been shown; the angle of force 17 from the backup roller has also been shown. For the paper to slip at the nip of rollers 11 and 12, force vector 16 from the reference edge and force vector 17 from the backup roller provide the forces necessary to overcome the driving force $\mu_d N_d$. By skewing backup roller 12 force vector 16 is smaller than it would be otherwise. Suppose, for example, that the backup roller 12 was made of the same material as drive roller 11. In that instance the value of the force causing the paper to slip must be equal to $\mu_d N_d$, and in such a case the paper would not be held against reference edge 13 but would be allowed to move away from reference edge 13. Consequently, the value of the backup roller force vector must be held to a lower level. Therefore, the coefficient of friction of the backup roller is decreased below that of the drive roller such that a force such as shown at 17 in FIG. 6 is provided to overcome the backup roller force vector. As a consequence, the remaining force on the sheet of paper which is supplied from the reference edge 13 need only be of the value of vector 16. Quite obviously as the coefficient of friction of the backup roller is increased the value of force vector 16 can be decreased until such time as there are no crumpling problems associated with driving paper along a reference edge.

Note, however, that while the forces tending to crumple the paper have been minimized by the arrangement shown in FIGS. 4 and 5, the necessary force driving the paper forward is maintained. Thus, this system provides for adequate force to move the heaviest stock of paper while minimizing the crumpling force on the lightest stock paper.

Figure 7:
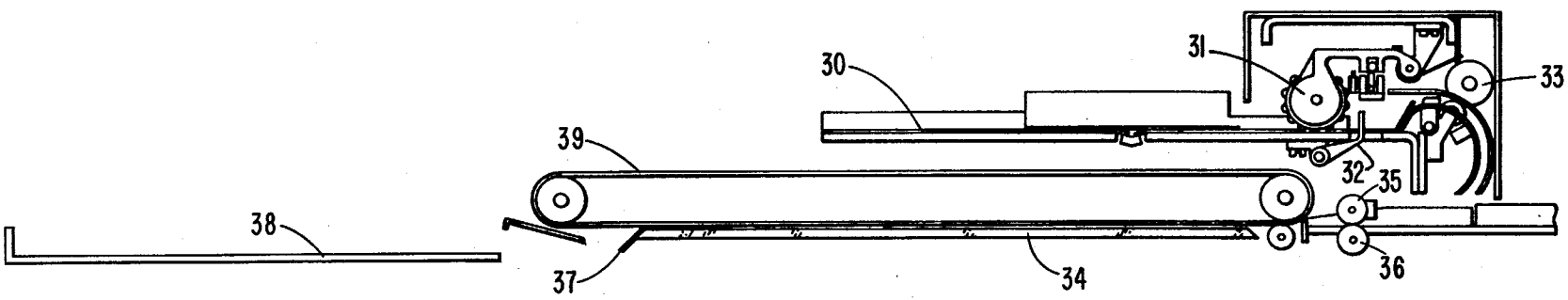
FIGS. 7 and 8 show an application of the invention in a paper feed device of a copier machine.

The principles of this invention can be utilized very advantageously in an automatic document feed mechanism in a convenience copying machine. In such a mechanism it is quite frequently necessary for the device to feed papers of different thicknesses and different beam strengths. For example, the operator of such a machine may desire to copy a carbon copy produced on very thin paper and may also desire to copy very thick and heavy documents such as offset masters. The device of this invention accomplishes the task without difficulty. For example, FIG. 7 illustrates an automatic document feed for use with a document copying machine. In this device a stack of paper is placed on the document tray 30 and positioned by hand against gate 32 under the paper feed roll 31 which is raised upwardly from the position shown in FIG. 7. After pressing a start button paper feed roll 31 causes the topmost sheet of the stack to be shingled out to the nip rolls 33 which then carries the sheets one-at-a-time to the document glass platen 34. In order that the sheets be registered against a reference edge, alignment rolls 35 and 36 are provided. At the conclusion of the copying operation the exit gate 37 is lowered and the document is fed from the glass platen 34 to the exit tray 38 by drive belt 39. The next sheet of paper is then fed by nip rolls 33, alignment rolls 35 and 36 and drive belt 39 into position on the glass platen.

Figure 8:
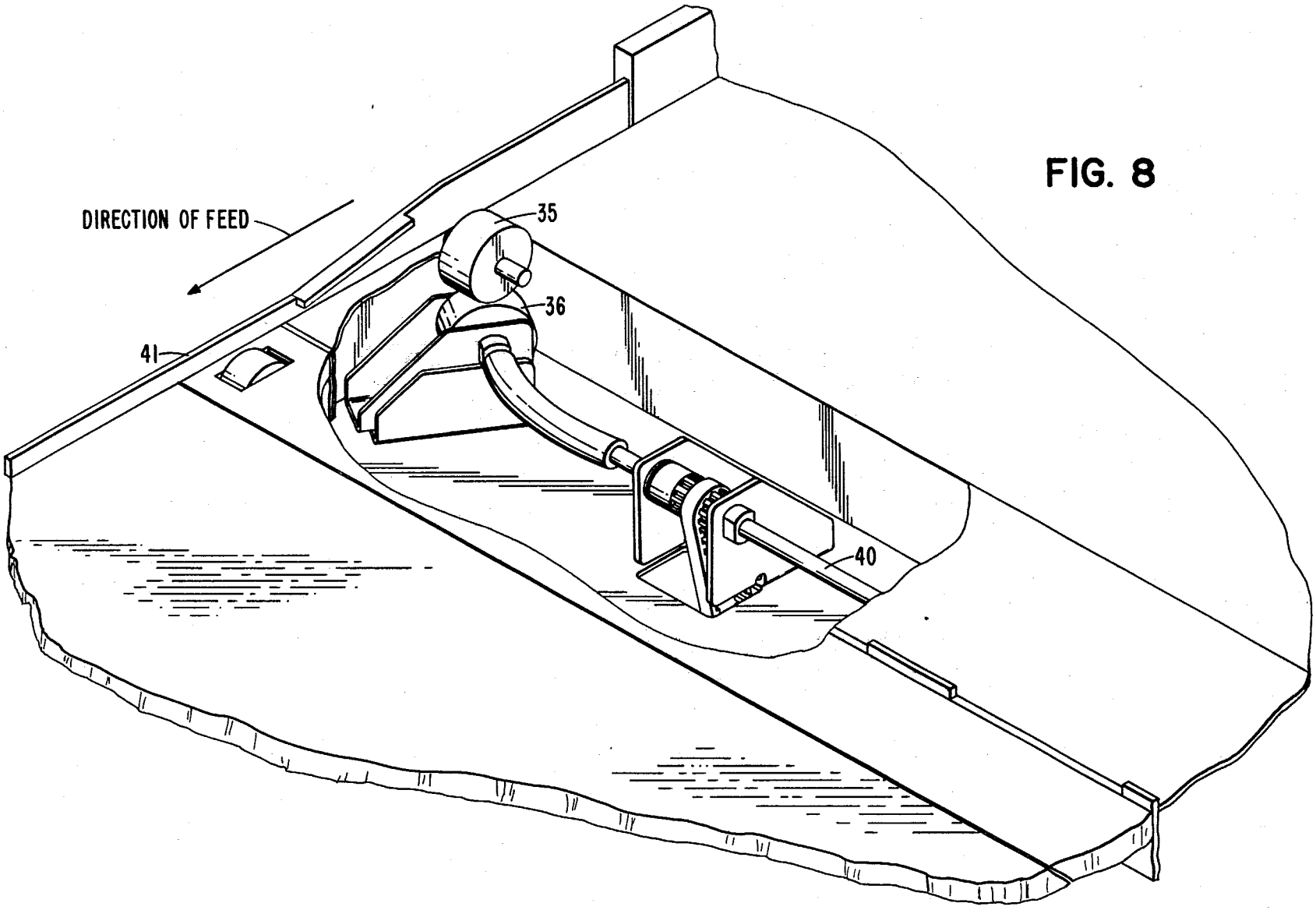

Alignment rolls 35 and 36 are shown in FIG. 8. Note that drive roll 36 is driven through shaft 40 from a motor, not shown, and is positioned in such a manner as to move a piece of paper against reference edge 41. Backup roll 35 is skewed relative to drive roll 36 and away from reference edge 41 in order to minimize the crumpling force produced from reference edge 41 on thin sheets of paper as described above, while maintaining a high driving force in the paper feed direction.

This invention may also be utilized in the paper path of a document copying machine wherein the copy sheets are registered against a side guide as the sheets move toward an imaging station or a transfer station in order to receive an image of the original document. The invention quite obviously can be used in any paper positioning apparatus wherein it is desired to register the moving documents against a side guide or where it is an object to move papers slightly to one side as they are moved down a path.

PRIOR ART

It is interesting to note that the invention described above is not found in any known prior art despite the great amount of engineering effort that has been done relative to moving paper.

U.S. Pat. No. 3,107,089 relates to a sheet transport system for sheet side registration. Pressure rolls are disposed oppositely to drive rolls 20 and are formed of a material having a high coefficient of friction as compared to the drive rolls. The pressure roll is at an angle to the side guide such that the roll will exert a force on the sheet tending to drive the sheet toward the side guide. When the sheet presses against the side guide this is said to cause a slight clockwise turning of the sheet which initiates a pivotal movement of the pressure roll into an inactive position and the pressure of the sheet edge against the side guide is relieved. It is apparent that this patent is directed to the same problem as the instant invention but provides a considerably different solution not dependent upon the discoveries described herein.

U.S. Pat. No. 3,175,824 shows sheet driving aligning mechanisms which move sheets against a registration edge. The drive means are beveled wheels located beneath the sheet of paper and castor wheels above the sheet. The castor wheels are cocked at an angle to turn the paper toward the registration edge.

U.S. Pat. No. 3,779,443 relates to a device to position at least one edge of a flexible film and provides both upper and lower rollers which are oblique to the direction of movement in order to move the film against a reference guide.

U.S. Pat. No. 3,040,946 shows pinch rollers which are oppositely skewed to a wire or tube stock, the wires being operated upon by swaging machine which tends to rotate the tube or wire. The purpose of the oppositely skewed pinch rolls is to prevent the wire from being twisted by providing a countertwist. While this piece of prior art shows oppositely skewed rollers, it is evident that the effect is to provide a twist to a cylindrical shape; this application of forces is quite different than this invention wherein the forces described are relative to a plane.

IBM TECHNICAL DISCLOSURE BULLETIN, Vol 18, No. 5, October 1975, pp. 1307–1308, shows an arrangement in which rollers are cocked at about 45° to the reference edge in order to drive the paper to the reference edge against a switch which then disengages the drive rollers and engages another pair of rollers which are cocked at an angle of only 6° to the reference edge.

IBM TECHNICAL DISCLOSURE BULLETIN, Vol. 17, No. 10, March 1975, p. 2971, shows a drive roller to drive the paper into the registration edge and a backup roller which is a spherical ball.

IBM TECHNICAL DISCLOSURE BULLETIN, Vol. 16, No. 9, February 1974, pp. 2921–2922, shows a backup roller which is a spherical ball against a drive roller which provides intermittent force on the paper by virtue of an eccentric operation.

It is clear from the above that while a great deal of effort has been expended, no one has previously arrived at the vector force analysis and the resulting skewing of backup and drive rollers with different coefficients of friction as has the current inventor.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. In a system for aligning a sheet of fragile material against a reference edge parallel to the direction of sheet travel;

first roll means skewed to the direction of travel for moving said sheet toward said reference edge;

mating roll means skewed oppositely to said first roll means for urging said sheet away from said reference edge; and said first roll means having a higher coefficient of friction than said mating roll means so that said sheet is moved toward said reference edge;

whereby the force tending to crumple said sheet at the reference edge is minimized while the drive force in the direction of sheet travel remains high.

2. The system of claim 1 wherein the first roll means is a drive roll and the mating roll means is a backup roll.

* * * * *